US006084498A

United States Patent [19]

Stelter et al.

[11] Patent Number: 6,084,498

[45] **Date of Patent: *Jul. 4, 2000**

[54] MAGNETIC DECOUPLER

[75] Inventors: Richard E. Stelter, Livermore, Calif.; David Choit, Dix Hills, N.Y.; Thomas J. Devaney, Watchung, N.J.

[73] Assignee: Dexter Magnetic Technologies, Inc., Fremont, Calif.

[ * ] Notice: This patent is subject to a terminal disclaimer.

[21] Appl. No.: 09/287,944

[22] Filed: Apr. 7, 1999

Related U.S. Application Data

[63] Continuation-in-part of application No. 09/137,568, Aug. 21, 1998, Pat. No. 5,959,520.

[51] Int. Cl.[7] ..... H01F 7/02; H01F 7/04

[52] U.S. Cl. ..... 335/306

[58] Field of Search ..... 335/284, 285–296, 335/302, 306; 24/303, 704.1; 340/572.9; 70/57.1

[56] References Cited

U.S. PATENT DOCUMENTS

| | | | |
|---|---|---|---|
| Re. 33,736 | 11/1991 | Clarke | 335/210 |
| 3,205,415 | 9/1965 | Seki et al. | 335/306 |
| 4,012,813 | 3/1977 | Martens et al. . | |
| 4,339,853 | 7/1982 | Lipschitz . | |
| 4,527,310 | 7/1985 | Vandebult . | |
| 4,531,264 | 7/1985 | Minasy . | |
| 4,603,453 | 8/1986 | Yokoyama . | |
| 4,651,136 | 3/1987 | Anderson et al. . | |
| 4,670,950 | 6/1987 | Wisecup et al. . | |
| 4,720,692 | 1/1988 | Jin | 333/144 |
| 4,774,503 | 9/1988 | Bussard . | |
| 4,829,276 | 5/1989 | Leupold | 335/306 |
| 5,019,863 | 5/1991 | Quimby | 335/210 |
| 5,084,690 | 1/1992 | Leupold | 335/306 |
| 5,635,889 | 6/1997 | Stelter | 335/306 |

*Primary Examiner*—Michael L. Gellner
*Assistant Examiner*—Raymond Barrera
*Attorney, Agent, or Firm*—Blakely Sokoloff Taylor & Zafman, LLP

[57] ABSTRACT

An improved magnetic decoupler with a magnetic field shape, strength and gradient optimized for releasing security tags, such as an antitheft device of the type described above. Due to the structure of the magnetic decoupler, it contains less ferrous material than prior art decouplers heretofore employed. Reduction in size of the magnetic decoupler, along with improved magnetic strength, derive from the magnet assembly including magnets arranged with orientations that increase axial magnetic field gradient by superposition of the magnetic fields of each magnet.

15 Claims, 4 Drawing Sheets

MAGNETIC DECOUPLER

RELATED APPLICATIONS

This is a continuation-in-part of application Ser. No. 09/137,568, filed Aug. 21, 1998, now U.S. Pat. No. 5,959, 520.

BACKGROUND OF THE INVENTION

1. Field of the Invention

The present invention relates generally to magnets and in particular to an improved magnetic decoupler for use with antitheft devices, in which the magnetic decoupler comprises a plurality of magnets arranged with their magnetic orientations orthogonal to each other.

2. Description of the Related Art

With reference to FIGS. 5 and 6, a known antitheft device used, for example, in retail sales stores that sell such goods as clothing or dry goods comprises a security tag, or simply, tag, usually having the shape of a disk or other generally planar shaped object. The tag contains a proprietary material that sets off an alarm, for example, if the goods are removed from the store without first detaching the tag. The tag is commonly attached to the goods by means of a tapered pin. The pin is inserted through the goods and into one side of the tag. The length of the pin is generally greater than the thickness of the tag. The side of the tag opposite that into which the pin is inserted is provided at its center with a nipple that accommodates the pin, so that the full length of the pin can be inserted into the tag. The pin may have one or more circumferential grooves. The nipple contains a mechanism for gripping the pin, or engaging a groove in the pin, and is constructed so that the pin can be easily inserted into the nipple, but once inserted, cannot be withdrawn until the gripping mechanism is mad e to disengage the pin, or more particularly, a groove in the pin. As a result, unauthorized removal of the tag from an article by, for example, a thief, cannot be readily accomplished.

FIGS. 5 and 6 illustrate the gripping mechanism 34 of a typical antitheft device. Gripping mechanism 34 is located in nipple 38 of disk or wafer 36 and includes both a collar 40, and a core 42. Collar 40 is secured to the interior of the base portion of nipple 38 and has a conical inner surface 44. Core 42 is located within nipple 38 and has an outer conical surface 46 that is urged upward into contact with the inner conical surface 44 of collar 40 by spring 48.

A vertical bore 50 is formed in core 42 and receives the shaft of tapered pin 54 when pin 54 is inserted into nipple 38. A horizontal bore 52 is also formed in core 42 and intersects the vertical bore 50. Two ball bearings 56 and 58 are located in bore 52. When outer surface 46 of core 42 engages the interior surface 44 of collar 40, surface 44 blocks the open ends of bore 52, causing ball bearings 56 and 58 to be wholly contained within bore 52. The size of ball bearings 56 and 58 is sufficiently large to extend into vertical bore 50 and to engage one of the grooves 60 of pin 54 when the pin is located in nipple 38.

Before pin 54 is inserted into nipple 38, core 42 is in the position illustrated in FIG. 5 and ball bearings 56 and 58 extend into bore 50. When pin 54 is first inserted into nipple 38, its tapered front end contacts balls 56 and 58 and urges core 42 downward against the force of spring 48. As core 42 moves downward, ball bearings 56 and 58 are permitted to slide radially outward from the shaft of pin 54 due to the conical shape of the interior surface of collar 40. Core 42 continues moving downward until the distance between ball bearings 56 and 58 is equal to the diameter of the shaft of pin 54. At this point, pin 54 is free to move into nipple 38. As a result of the foregoing, pin 54 is free to slide into nipple 38 at the user's discretion.

Once pin 54 has been placed in nipple 38, it cannot be removed therefrom without the use of a decoupler such as magnetic decoupler 10 of the present invention. If any attempt is made to remove pin 54 from nipple 38, the shaft of pin 54 moves slightly upward until ball bearings 56 and 58 engage any one of the grooves 60 formed by pin 54. Once this has occurred, the ball bearings 56 and 58 are forced into groove 60 by the inner conical surface of collar 40 and prevent the further removal of pin 54. Accordingly, pin 54, and along with it disk 36, cannot be removed from the article, for example, by a potential thief.

In order to unlock the disk 36 and permit the removal of pin 54, nipple 38 is inserted into a cavity of a magnetic decoupler having magnetic field in the cavity that pulls core 42 downward against the forces of spring 48 until the open ends of bore 52 are no longer blocked by collar 40, as illustrated in FIG. 6. As a result, the ball bearings 56 and 58 are free to move outward from vertical bore 50 in response to an upward tug on pin 54, allowing the pin 54 to be easily removed from the disk 36.

What is needed, then, is an improved magnetic decoupler that provides for removal of the antitheft device by a sales clerk or the like when the, article is purchased. The magnetic decoupler should include a cavity into which the nipple is inserted, and a permanent magnet structure of suitable design that provides a strong, highly focused, substantially vertical magnetic field in the cavity. The axial magnetic field gradient within the cavity should force the gripping mechanism in the nipple to disengage from the groove, allowing removal of the pin from the tag.

BRIEF SUMMARY OF THE INVENTION

Disclosed is an improved magnetic decoupler with a magnetic field shape, strength and gradient optimized for releasing a security tag, such as in the antitheft device of the type described above. Due to the structure of the magnetic decoupler, it contains less ferrous material than prior art decouplers heretofore employed. Reduction in size of the magnetic decoupler, along with improved magnetic strength, derive from the magnet assembly including magnets arranged with orientations that increase the axial magnetic field gradient provided by superposition of the magnetic fields of each magnet.

Increased magnetic field intensity and magnetic field gradient permits the improved magnetic decoupler to release security tag mechanisms with less ferrous material than heretofore employed. This makes possible the use of security tags that cannot be released by prior art detachers.

BRIEF DESCRIPTION OF THE SEVERAL VIEWS OF THE DRAWINGS

For the purpose of illustration of the invention, there is shown in the drawings an embodiment. It is to be understood, however, that the invention is not limited to the particular arrangements or geometric ratios shown. Other geometric ratios have demonstrated greater detaching forces than those required by antitheft devices available today. Other magnet arrangements employing magnets arranged with their orientations in quadarature have demonstrated less, but adequate decoupling, or detaching, forces. Thus, the embodiment of the present invention is illustrated by way of example and not limitation in the accompanying figures, in which.

DETAILED DESCRIPTION OF THE INVENTION

The present invention relates to an improved magnetic decoupler for use with antitheft devices. The magnetic decoupler comprises a plurality of magnets arranged with their magnetic orientations orthogonal to each other to increase the axial magnetic field gradient within a cavity formed by the magnetic decoupler by superposition of the magnetic fields of each magnet. In the following description, numerous specific details are set forth in order that a thorough understanding of the present invention is provided. It will be apparent, however, to one of ordinary skill in the art that the present invention may be practiced without these specific details. In other instances, well-known structures, materials, and techniques have not been shown in order not to unnecessarily obscure the present invention.

Quadrature Magnets

Magnets arranged in "quadrature" (hereafter "quadrature magnets" or "quadrature magnet assembly") are configured so that the magnetic orientation of each magnet is orthogonal to that of its neighbors, providing an important performance improvement in applications utilizing magnet assemblies depending on the flux density. Quadrature magnets result in greater force to weight ratio in Lorenz force applications and even greater improvements in force applications depending on magnetic attraction or repulsion, i.e., where force is proportional to flux density squared. Quadrature magnets also provide improved magnetic field shapes in applications where, as in the present application, optimal flux density gradients are desired.

A quadrature magnet assembly was not possible before the introduction of "square" magnet materials. Square magnet materials are those with essentially a straight line in the second quadrant of the hysteresis curve, where the intrinsic coercivity value (as measured in Oersteds) exceeds the value of residual induction (as measured in Gauss). Magnets made of ferrite, Samarium Cobalt, and Neodymium Iron are currently the most popular materials of this type. Prior to the introduction of these materials it was impractical to use a quadrature magnet assembly because each magnet in the assembly would demagnetize its neighbor to some extent when its induction exceeded the intrinsic coercivity of its neighbor.

Individual magnet geometry is a major factor in selecting an application in which a quadrature magnet assembly is used because the individual magnet geometry establishes the operating point of the magnet. Individual magnet geometry establishes the self demagnetizing factor of the magnet. Intrinsic coercivity minus the value of the self demagnetizing field determines the value of the external demagnetizing field the magnet can withstand without permanent loss of field strength. Magnetic circuit geometry determines the overall effectiveness of a group of magnets and ferrous components arranged to work together.

Detailed Description

Figure 1:
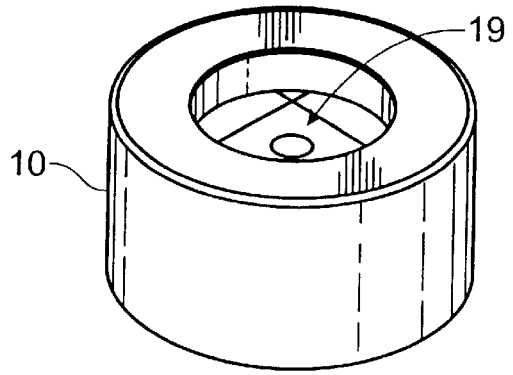
FIG. 1 is an assembly view of an embodiment of the magnetic decoupler of the present invention.
Figure 2:
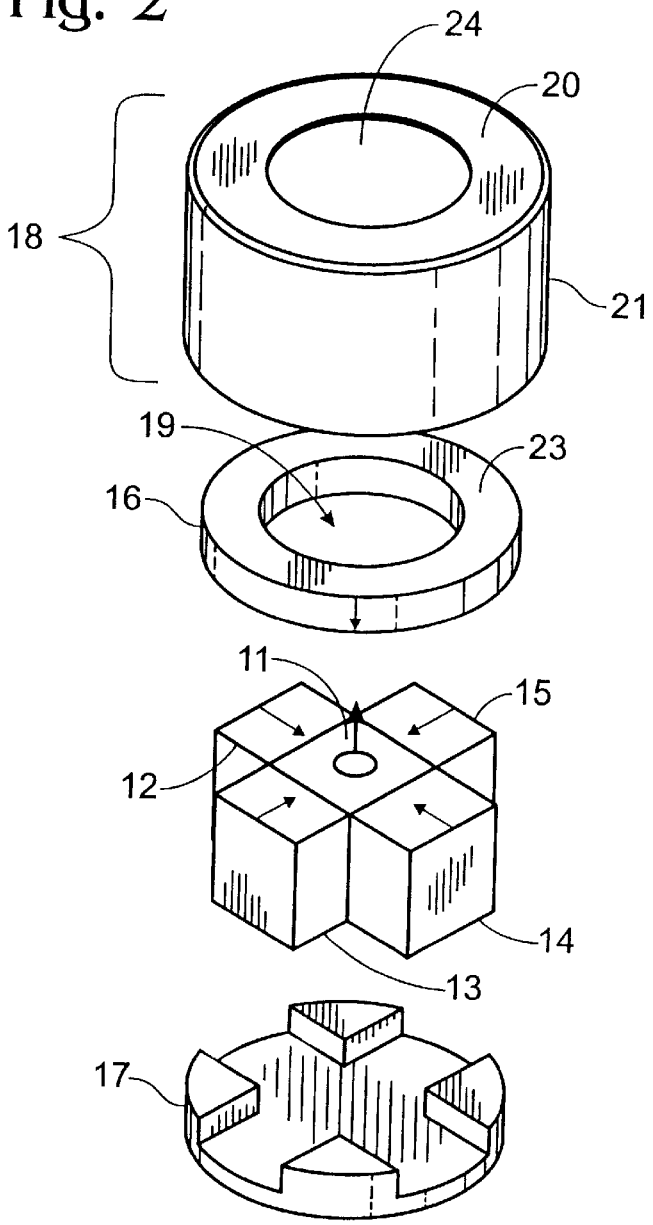
FIG. 2 is an exploded view of an embodiment of the magnetic decoupler of the present invention.

According to the present invention, a powerful permanent magnet structure having an axial magnetic flux density gradient greater than 55 Tesla per meter along the desired flux path is provided. With reference to an embodiment illustrated in FIGS. 1 and 2, one component of the magnet assembly is a high coercivity ring shaped, or annular, permanent magnet 16 having a bore 19 of sufficient diameter to accommodate, e.g., the nipple 34 of a security tag. In one embodiment, the magnet assembly further comprises a cruciform arrangement of powerful high coercivity permanent magnets 11, 12, 13, 14 and 15 with magnetic orientations arranged in "quadrature". Optimum dimensions may be obtained through numerical analysis. However, a working model, described herein, provides outer corners of the magnets in the cruciform magnet assembly that approximate the outer diameter of the annular magnet 16. In an alternative embodiment, the magnets 12–15 may be of trihedral shape, rather than rectangular or square shape as illustrated in FIGS. 1 and 2. The diagonal dimension of a central magnet 11 of the cruciform magnet assembly, a parallelepiped-shaped magnet with a square cross section normal to its magnetic axis, approximates the inner diameter of the annular magnet 16 defined by bore 19.

The annular magnet 16 and cruciform assembly are aligned coaxially and are in contact with each other, as illustrated in FIG. 1. The polarity of the central magnet 11 is opposite to that of the annular magnet 16 so that flux lines in the annular aperture defined by bore 19 proceed from the face of the central magnet through the bore of the annular magnet to the distal, or opposite, face 23 of the annular magnet. The four additional magnets of the cruciform magnet assembly are parallelepiped magnets 12, 13, 14 and 15, that abut the annular magnet 16 and the central magnet 11 with polarities radial to the central magnet and normal to that of both the annular and the central magnet, as illustrated in FIG. 2. These four magnets are hereinafter collectively referred to as radial magnets. Each of the radial magnets is positioned so the face abutting the central magnet approximates the polarity at the interface of the central magnet and the annular magnet.

A steel base 17 with features matching the cruciform magnet assembly provides mechanical positioning and a path for flux fringing from the joints between magnets in the cruciform magnet assembly. A steel cup 18 with a hole 24 in its flat end 20 approximating the inner diameter of the annular magnet 16, defined by bore 19, is fitted to the magnet assembly comprising the annular magnet, the cruciform magnet assembly, and the steel base. The flat end 20 contacts the distal face 23 of the annular magnet remote from the cruciform magnets, arranged in quadrature, to further concentrate and focus the lines of magnetic flux from the distal face of the annular magnet into the bore of the annular magnet 16. The wall 21 of the steel cup 18 contains stray magnetic flux to provide some degree of magnetic shielding for the magnetic decoupler assembly.

When the antitheft device is to be unlocked, the nipple 34 is placed in the cavity defined by the hole 24 in the steel cup and the inner diameter of the annular magnet 16 defined by bore 19, and the strong magnetic field gradient therein causes the gripping mechanism of the tag to disengage from the pin 54, or the groove 60 of the pin. The action is the same as in a magnetic separator wherein the magnetic field gradient along the pin induces a magnetic field in the pin with the same polarity as the inducing field. The polarity at the end of the pin approaching the central square magnet is then opposite in sign to that on the face of the central square magnet to establish a strong attractive force.

As a result of the above described arrangement of magnets, flux lines leaving the surface of central magnet 11 nearest the bore 19 of annular magnet 16 pass through the bore of and return to the distal surface of annular magnet 16. The flat end 20 of the cup shaped steel shell 18 abuts on the distal face 23 of annular magnet 16 to concentrate and focus flux lines from the distal face of the annular magnet into the bore formed by the hole in the flat end of the cup and the inner diameter of annular magnet 16.

The hole in the steel cup and the inner diameter of the annular magnet form a bore or cavity 19 of sufficient size to accommodate the nipple 34 of the antitheft device with which the magnetic decoupler is to be used and into which the security tag nipple is inserted for unlocking. Flux from the distal face 23 of annular magnet 16 passing through the ring shaped pole piece formed by the flat end of the steel cup to the proximate face of central magnet 11 via the bore 19 can be thought of as being squeezed toward the center of the bore 19. The magnetic flux in the bore 19 due to the superposition of the fields of individual magnets, as a result, is extremely strong and is almost completely vertical in the area of the pin 54.

Figure 3:
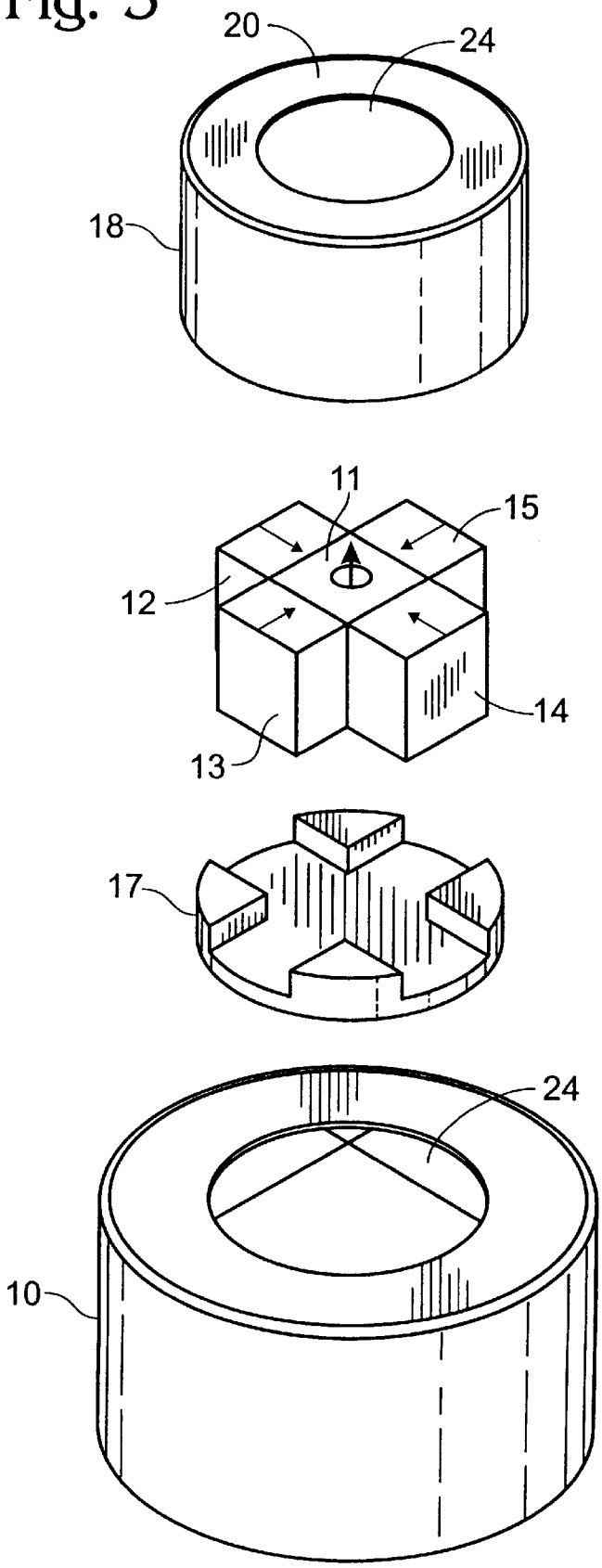
FIG. 3 provides an assembly and exploded view of an embodiment of the magnetic decoupler of the present invention.
Figure 4:
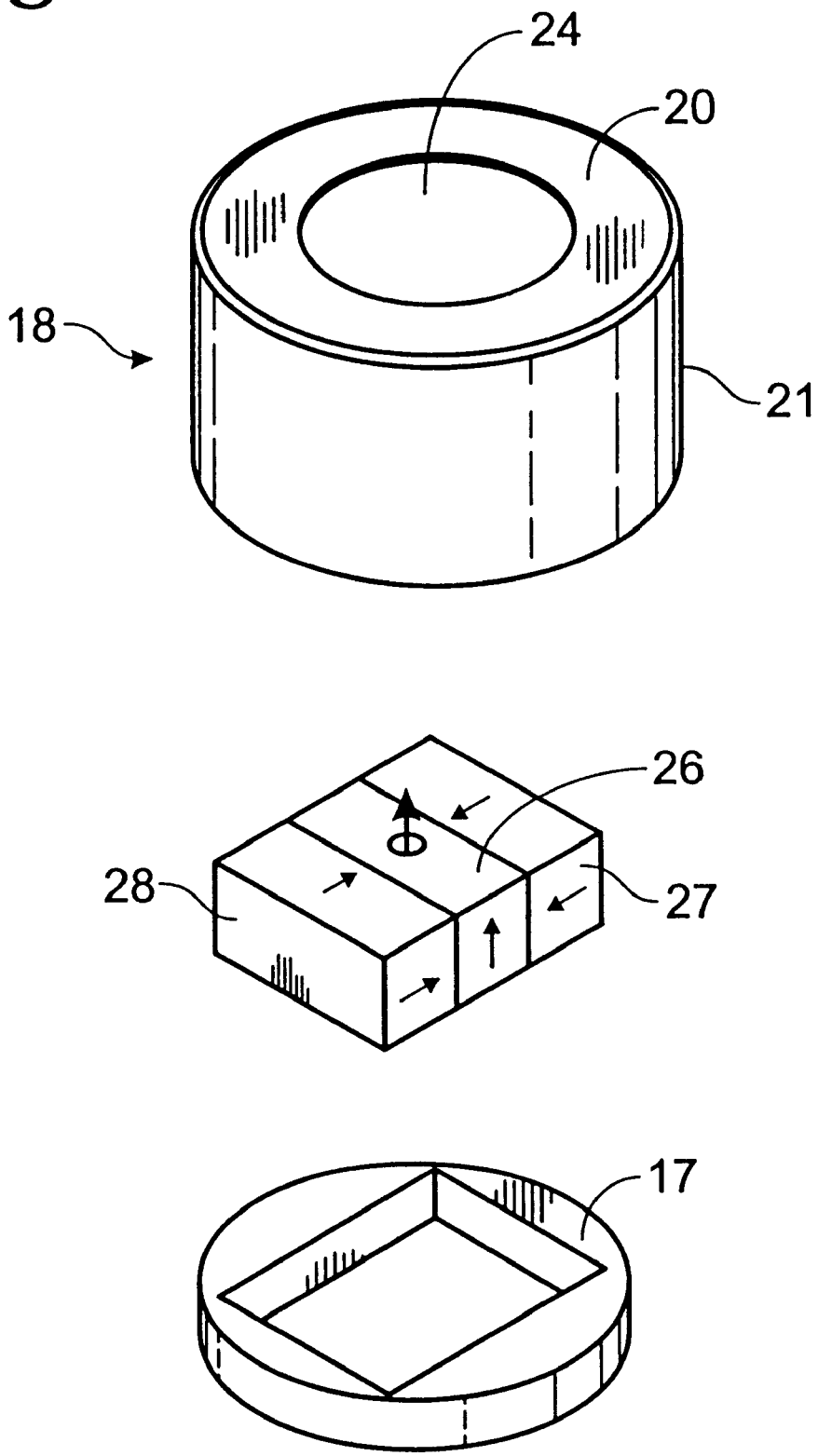
FIG. 4 illustrates an alternative magnet assembly as may be embodied in the magnetic decoupler of the present invention.
Figure 5:
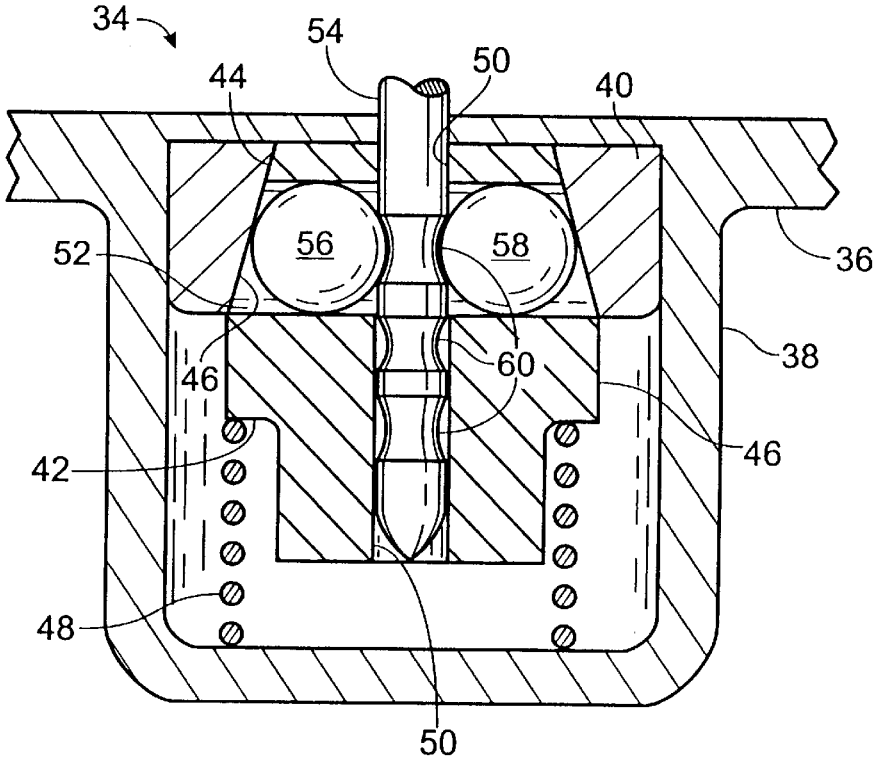
FIG. 5 is a sectional view of the gripping mechanism of the antitheft tag device in which the tag is shown engaging the tapered pin.
Figure 6:
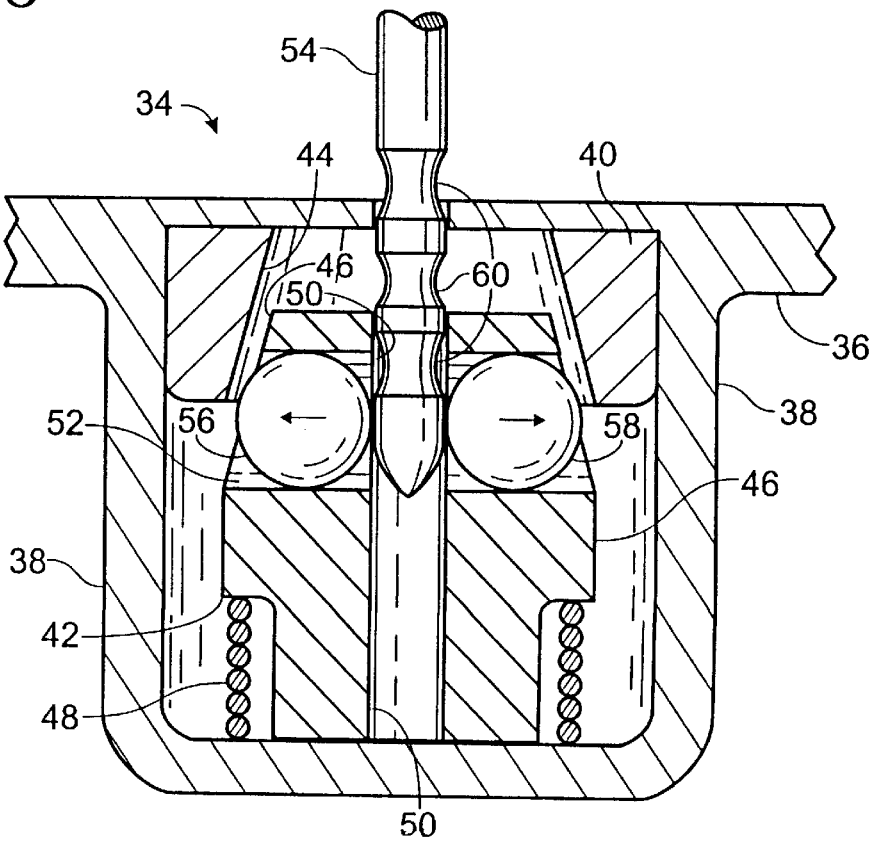
FIG. 6 is a sectional view of the gripping mechanism of the antitheft tag device in which the nipple of the antitheft tag is inserted in the bore of the magnetic decoupler of the present invention to retract the gripping mechanism, allowing the pin to be removed from the tag.

The gripping mechanism in the nipple of the antitheft disk 36 can be unlocked only by being subjected to a strong magnetic force acting along the pin axis (in the orientation of FIGS. 3 and 4). A force component acting perpendicularly to this direction not only is useless, but appears to hinder the unlocking of the gripping mechanism 34. When the nipple 38 of the disk 36 is inserted in the cavity 19, therefore, a magnetic flux with as strong a vertical gradient along the axis of pin 54 (in the orientation of FIG. 5), and as weak a horizontal component, as possible must be provided.

By superposition of the magnetic fields of radial magnets 12, 13, 14 and 15 on central magnet 11, flux density in the magnetic decoupler cavity is maximized on the face of central magnet 11 proximate to annular magnet 16. This maximizes the axial flux density gradient to exert maximum attractive force on the core 42 of the gripping mechanism to move it downward, away from core 40, so that ball bearings 56 and 58 disengage the groove, thereby allowing for removal of the pin. The attractive force is proportional to the product of the field intensity in the cavity 19 of the magnetic decoupler, which is proportional to the intrinsic flux density of the magnet material used, and the field induced in the pin 54. As the ferrous components of the security device becomes smaller, and therefore, magnetically weaker, the magnetic field provided by the decoupler magnet assembly must increase to compensate. The high field and field gradient produced by the magnet arrangement described herein allows the use of less ferrous material in the core and/or collar, etc., of the security device than heretofore possible. This smaller core (and/or larger springs 48) foils attempts to remote the tag with simple, strong magnets.

The magnet assembly of the present invention is substantially more effective for use in unlocking newer antitheft devices than prior magnetic decouplers based on coaxial assemblies of axially oriented rare earth ring magnet and disk magnet combinations, or the composite magnet arrangement of U.S. Pat. No. 4,339,853.

With reference to FIG. 3, another embodiment of the present invention is illustrated. Absent from the magnet assembly is the annular permanent magnet 16 of the previously described embodiment. The magnet assembly comprises the cruciform arrangement of high coercivity permanent magnets 11, 12, 13, 14 and 15 with magnetic orientations arranged in "quadrature".

The polarity of the central magnet 11 is such that flux lines proceed vertically from the face of the central magnet. The four additional magnets of the cruciform magnet assembly are the radial magnets 12, 13, 14 and 15 that abut the central magnet 11 with polarities radial and normal to the central magnet, as illustrated in FIG. 3. The steel base 17 with features matching the cruciform magnet assembly provides mechanical positioning and a path for flux fringing from the joints between magnets in the cruciform magnet assembly. A steel cup 18 with a hole 24 in its flat end 20 is fitted to the cruciform magnet assembly, and the steel base. The outer comers of the radial magnets approximate the outer diameter of the steel cup 18. The diagonal dimension of the central magnet 11 of the cruciform magnet assembly approximates the inner diameter of the opening 24 in steel cup 18. The flat end 20 of steel cup 18 contacts the cruciform magnets, arranged in quadrature, to further concentrate and focus the lines of magnetic flux from the distal face of magnet 11 into the hole 24.

With reference to the embodiment illustrated in FIG. 3, when the antitheft device is to be unlocked, the nipple 34 is placed against the hole 24 in the steel cup and the distal face of magnet 11. The magnetic field gradient causes the gripping mechanism of the tag to disengage from the pin 54, or the groove 60 of the pin.

Given the arrangement of magnets illustrated in FIG. 3, flux lines leaving the surface of central magnet 11 nearest the face 24 pass through the hole 29 and return to the distal surface of magnets 12–15. The flat end 20 of the cup shaped steel shell 18 abuts on the distal face magnets 12–15 to concentrate and focus flux lines from the distal face of central magnet 11 into the hole in the flat end of the cup. The magnetic flux passing through hole 24 is very strong and is substantially vertical in the area of the pin 54 due to the superposition of the fields of individual magnets.

By superposition of the magnetic fields of radial magnets 12, 13, 14 and 15 on central magnet 11, flux density in the magnetic decoupler is maximized on the face of central magnet 11 proximate to pin 54. This maximizes the axial flux density gradient to exert maximum attractive force on the core 42 of the gripping mechanism to move it downward, away from core 40, so that ball bearings 56 and 58 disengage the groove, thereby allowing for removal of the pin.

The above described embodiments contemplate abutting central magnet 11 with a cruciform arrangement of magnets 12–15, with or without the presence of annular magnet 16, to generate the desired external magnetic field. The embodiment illustrated in FIG. 4 contemplates a three magnet structure, in which central magnet 26 is sandwiched between magnets 27 and 28. In the embodiment illustrated in FIG. 4, the magnet assembly comprises the arrangement of high coercivity permanent magnets 26–28 with magnetic orientations arranged such that flux lines proceed vertically from the face of the central magnet 26. The tri-magnet assembly is similar to the cruciform magnet assembly, except there are two, instead of four, radial magnets that abut the central magnet 26 with polarities radial and normal to the central magnet, as illustrated in FIG. 4. The steel base 17 is configured to match the tri-magnet assembly and provide mechanical positioning and a path for flux fringing from the joints between magnets in the tri-magnet assembly. As in the other embodiments, a steel cup 18 with a hole 24 in its flat end 20 is fitted to the tri-magnet assembly, and the steel base. The outer corners of the radial magnets approximate the outer diameter of the steel cup 18. The diagonal dimension of the central magnet 26 tri-magnet assembly approximates the outer diameter of steel cup 18. The flat end 20 of steel cup 18 contacts the three magnets to further concentrate and focus the lines of magnetic flux from the distal face of magnet 26 into the hole 24.

The tri-magnet assembly embodiment is illustrated without an annular magnet abutting the distal face of the structure. However, it is appreciated by those of ordinary skill in the art that an annular magnet also may be utilized in this embodiment to provide the features described above with respect to the embodiment illustrated in FIGS. 1 and 2. Moreover, while magnets 27 and 28 are rectangular in shape, they may be trihedral or otherwise shaped. Using the embodiment illustrated in FIG. 4, and given the flux lines leaving the surface of magnet 26, an antitheft device may be unlocked in the manner heretofore described.

There are, of course, many possible alternatives to the described embodiments that are within the understanding of one of ordinary skill in the relevant art. The present invention is limited, therefore, only by the claims presented below.

What is claimed is:

1. A permanent magnet assembly, comprising:

an annular shaped magnet, having an inner diameter that defines a cavity, the annular shaped magnet situated about a central axis and generating a first external magnetic field;

a central polyhedral shaped magnet, coaxially aligned with the annular shaped magnet, the central magnet generating a second external magnetic field of opposite polarity to the first external magnetic field;

a plurality of polyhedral shaped magnets that abut the central magnet and the annular shaped magnet, the plurality of magnets having a magnetic field orientation normal to the first and second external magnetic fields to form a magnetic circuit that generates an axially aligned external magnetic field in the cavity.

2. The permanent magnet assembly of claim 1, wherein the central polyhedral shaped magnet, has an outside dimension that approximates the inner diameter of the annular shaped magnet.

3. The permanent magnet assembly of claim 2, further comprising a steel base upon which the plurality of magnets is situated.

4. The permanent magnet assembly of claim 3, further comprising a steel shell surrounding the annular magnet, the plurality of magnets, and the steel base to reduce fringing flux.

5. The permanent magnet assembly of claim 4, wherein the central polyhedral shaped magnet is a parallelepiped shaped magnet.

6. The permanent magnet assembly of claim 5, wherein each of the plurality of polyhedral shaped magnets is a parallelepiped shaped magnet such that the plurality of magnets abut the central magnet in a cruciform arrangement.

7. The permanent magnet assembly of claim 1, wherein the annular shaped magnet is a high coercivity permanent magnet.

8. The permanent magnet assembly of claim 7, wherein each of the plurality of magnets is a high coercivity permanent magnet.

9. The permanent magnet assembly of claim 8, wherein the central magnet is a high coercivity permanent magnet.

10. A magnet assembly, comprising:

a first polyhedral shaped magnet centered about an axis, the first magnet generating an external magnetic field in the direction of the axis;

at least two additional polyhedral shaped magnets radially aligned with the first magnet, each having a magnetic field orientation normal to the external magnetic field generated by the first magnet to form a magnetic circuit that generates an axially aligned external magnetic field; and an annular shaped magnet coaxially aligned with the first polyhedral shaped magnet, the annular shaped magnet having an inner diameter that defines a cavity centered about the axis, the annular shaped magnet generating in the cavity a second external magnetic field of opposite polarity to the external magnetic field generated by the first magnet.

11. The magnet assembly of claim 10, further comprising a steel base upon which the magnets are situated.

12. The magnet assembly of claim 11, further comprising a steel shell surrounding the annular magnet, the pair of magnets and the steel base to reduce fringing flux.

13. The magnet assembly of claim 10, wherein the annular shaped magnet is a high coercivity permanent magnet.

14. The magnet assembly of claim 13, wherein the at least two additional magnets are high coercivity permanent magnets.

15. The magnet assembly of claim 14, wherein the first magnet is a high coercivity permanent magnet.

* * * * *